US007632197B2

(12) United States Patent
Rodengen et al.

(10) Patent No.: US 7,632,197 B2
(45) Date of Patent: Dec. 15, 2009

(54) SYSTEM FOR CONFIRMING HIT LOCATIONS ON TENNIS COURT BOUNDARIES

(75) Inventors: Jeffrey Rodengen, Davie, FL (US); Roger Tyzzer, Hope Island (AU); Ray L. Hauser, Boulder, CO (US)

(73) Assignee: Write Stuff Enterprises, Inc., Fort Lauderdale, FL (US)

( * ) Notice: Subject to any disclaimer, the term of this patent is extended or adjusted under 35 U.S.C. 154(b) by 12 days.

(21) Appl. No.: 11/738,826

(22) Filed: Apr. 23, 2007

(65) Prior Publication Data

US 2007/0249435 A1 Oct. 25, 2007

Related U.S. Application Data

(60) Provisional application No. 60/745,284, filed on Apr. 21, 2006.

(51) Int. Cl.
*A63B 71/00* (2006.01)
*A63B 71/06* (2006.01)

(52) U.S. Cl. ..... 473/467; 473/606; 473/490

(58) Field of Classification Search ..... 473/467, 473/606, 490
See application file for complete search history.

(56) References Cited

U.S. PATENT DOCUMENTS

| | | | | |
|---|---|---|---|---|
| 2,735,780 | A * | 2/1956 | Compte et al. | 106/31.03 |
| RE32,842 | E * | 1/1989 | Wigoda | 473/467 |
| 5,242,830 | A * | 9/1993 | Argy et al. | 436/5 |
| 5,394,824 | A * | 3/1995 | Johnson, Jr. | 116/203 |
| 6,941,818 | B2 * | 9/2005 | Rakowski | 73/762 |
| 7,241,237 | B2 * | 7/2007 | Iggulden | 473/606 |
| 2006/0287140 | A1 * | 12/2006 | Brandt et al. | 473/467 |

* cited by examiner

*Primary Examiner*—Raleigh W. Chiu
(74) *Attorney, Agent, or Firm*—Robert M. Schwartz; David W. Barman

(57) ABSTRACT

The present invention is an article and process for determining the site of impact of a movable object on a treated surface, where a tennis ball is treated with a striking composition, and a boundary line region is treated with a receiving composition such that when the striking composition and the receiving composition are in physical contact, a calorimetric indicator is left on the receiving composition to indicate the point of contact.

26 Claims, 2 Drawing Sheets

(SECTION A–A OF FIG.1)

SYSTEM FOR CONFIRMING HIT LOCATIONS ON TENNIS COURT BOUNDARIES

INDEX TO RELATED APPLICATIONS

This application claims the benefit of U.S. Provisional Patent Application Ser. No. 60/745,284, filed Apr. 21, 2006. The disclosure of which is incorporated herein by reference in its entirety.

BACKGROUND OF THE INVENTION

Tennis courts and other sports use well-marked boundaries to define whether a ball is in play or out of play. If any part of a ball contacts the white line, it is in play; if it is outside of the white line it is out of play. In tennis, the boundaries are definitive for both serves and for rallies in accordance with rules of the International Tennis Federation.

In competitive tennis, calls are usually made by line judges who view from an extrapolation of the line being judged, and calls may be over-ruled by an umpire sitting on a chair along the net line at the center of the tennis court. Balls may be traveling at more than 100 miles per hour, and very fast observation and perception is required for accurate calls.

Two widely used types of tennis courts are clay courts and hard courts. Clay courts are made of crushed shale, stone or brick, and can be either red or green. The red clay is slower than the green, or Har-Tru® "American" clay. On clay courts, a mark is left on the surface. In case of a disputed call, the umpire may make a close-up inspection to discern the exact location of the ball impact.

Hard courts are usually made of cement or asphalt. Hard courts use a painted finish; generally, no impact marks are left on the court surface that can be used in the event of a line call dispute.

Although line judges and/or umpires use their best ability to make accurate calls, sometimes errors happen and could happen. Many calls are pivotal in the outcome of professional tennis matches. There is need for a simple, efficient means of improving the accuracy of line calls.

The Cyclops®, Mac Cam®, Hawk Eye®, ShotSpot® and Auto-Ref® systems have been tried. Cyclops® (William Carlton, Malta) uses a periscope system operated by two people per line, and it gives a personal line of sight very close to the boundary surface. The Cyclops® evolved into a system using five parallel infrared beams that could be interrupted by the ball in motion, and it gives colored light response if in play and an audible response if out. This system has been used only for service line calls.

The Mac Cam® (DEL Imaging Systems, LLC., Cheshire, Conn.) system uses high-speed cameras, which can be reviewed in case of a controversial line call. This system has only been used as theatre for the T.V. audience, and has not been developed for use in international tournaments.

Signal Processing Systems, Inc. (Sudbury, Mass.) has developed a system using wires imbedded in a ribbon 0.2 mm thick that is placed within the boundary, perhaps over-coated with the paint of the court. Ball hits on the ribbon sends an auditory signal to earphones being worn by the line umpires, but steps by players give more of a crunch sound.

The Hawk Eye® (Winchester, England) system uses up to nine high-speed digital cameras with computer software to track and map the impact point of the ball. Each camera is connected by a digital video cable to a computer; an impact point is displayed on the video screen at the umpire's chair or on a large T.V screen within the stadium for public viewing.

The philosophy of tennis calls presently leans in the direction of having live individuals make the calls, with opportunity for disputing a call immediately, as is done on the few clay courts presently used for professional tennis matches.

The International Tennis Federation (ITF)(London, England) has published a detailed list of requirements for automated line-calling systems ("Automated Line-Calling Systems: ITF Evaluation, ITF Technical Centre (February 2005)). In short, any new system must improve considerably upon the 40-mm (1.6 inch) best accuracy of human line umpires and it must not affect normal play in any manner. An instant call is desired, audible to umpire, players and audience.

The International Tennis Federation has recently approved an electronic/optic system for ball tracking that gives a historical record of ball location and impact, which provides a means for reviewing disputed calls. This is an elaborate and expensive system for installation and operation.

However, the majority of tennis courts cannot use many of these sophisticated and expensive systems. There is a need for a reliable and relatively inexpensive system for determining the impact position of tennis balls on a tennis court.

SUMMARY OF THE INVENTION

The present invention is a process and method for determining the impact position of a tennis ball on a tennis court. The present invention also relates to the manufacturing and/or treatment of a tennis ball with a striking composition such that the striking composition does not discolor the hands of a user or any equipment. The striking composition is preferably a chemical composition that will create a color metric change on a tennis court in those areas that are treated with a receiving composition.

In one embodiment the striking composition is acidic and the receiving composition is basic. Alternatively, the striking composition may be basic and the receiving composition may be acidic.

The modern tennis ball comprises two major parts, the inner core and the outer fibrous cloth covering. The inner core is constructed of two half-shell pieces of formed rubber, which are joined together with adhesive to form a single core. Two dumbbell shaped pieces of cloth are attached to the ball core by adhesive. The thickness and density of the ball cloth is matched to the court type for which the ball is designed. Current ITF regulations imposed by the ITF restrict the color of the ball to yellow or white and the seams of the tennis ball must be stitchless. Strict limits are also in place for the mass and diameter for tennis balls. Because of these strict limits, the present invention must not add size, prohibitive mass, or change the color of the ball to be used.

The tennis ball of the present invention may be prepared in many different ways. The fibrous cloth outer covering comprises felt fibers that may have the striking composition incorporated into the felt before the ball is manufactured.

Alternatively, the felt fibers of the tennis ball cloth of the present invention may have the striking composition applied after the ball is manufactured. Application of the striking composition may be in any manner as is known in the art that may include any type of spray applicator and/or brushes, such as paintbrushes.

Further contemplated in the present invention, is a receiving composition applied to the upper, or exposed top surface of a conventional tennis court on each of the boundary lines and on the regions adjacent to the boundary lines. Application of the receiving composition may be in any manner as is known in the art that may include any type of spray applicator and/or brushes, such as paintbrushes, paint rollers and the like. Alternatively, the receiving composition may be incorporated into court paint and coatings to be applied to the court when the court is painted and marked.

The present invention provides for a mark that is created when the ball, having a striking composition on the surface, contacts the tennis court surface in an area in which the receiving composition has been applied. A colormetric change occurs on the court at the impact site because the combination of the chemicals in the striking composition react with the chemicals in the receiving composition. The area on the court where the color change has occurred may then be examined by players and/or tennis game officials to determine if a tennis ball landed in bounds of out of bounds. After observing the location of the color change, and deciding if a tennis ball landed in bounds of out of bounds, the color is preferably removed with an environmentally and human friendly solvent. Alternatively, the mark may be removed with a brush, broom, or cloth.

Also preferred, is that the removable composition of the line of the mark from a specific spot does not remove the receiving composition to the extent that a subsequent strike would not be visible. This would require reactivation of the area.

Also, contemplated would be the ability to apply additional receiving composition to reactivate an area where the receiving composition has changed color due to contact with the striking composition.

Also, contemplated in the present invention would be the use of polymers and possibly polymers conjugated with dyes or color metric chemical indicators that would be applied to both the ball and surface when used in applying either or both of the striking composition and the receiving composition respectively.

The present invention uses a leuco dye. A leuco dye is a dye whose molecules can acquire two forms, one of which is colorless and one that has a color. A leuco dye, by definition, changes color with a change of pH, a transition somewhat akin to that of color indicators used for titrations in chemical analysis. More particularly, the color transition is also used for carbonless carbon paper, and a review of this technology can be found at www.carbonless.org.

An example of the color change characteristics of a leuco dye is Crystal Violet Lactone (CVL), which in its lactone form is colorless or slightly yellowish, but in low pH, when it is protonated, it becomes intensely violet as a result of the low pH.

In one embodiment, the present invention uses the ability of a leuco dye to transfer and change color quickly upon contact with a coating containing an acid or an alkali, thus providing a color change in the coating.

The color change in the system of the present invention marks the points of impact and displays an impact pattern of the spot where the tennis ball impacts on the court treated with a receiving composition. This provides a marking that is visible to the line judge, the chair umpire, the players and the audience (live and by television).

A number of embodiments have been found to be effective for this marking. A number of dyes and coating formulations have been effective to varying degrees.

In one embodiment, a preferred coating uses 91% isopropanol solvent with salicylic acid as the key ingredient and polyvinylpyrollidone (PVP) as the binder. These are selected for fast evaporation and drying, since play will continue soon after application.

Both the salicylic acid and PVP binder are sufficiently soluble in water to be removed from the court.

Further, ammonia may be used for decoloring balls after marks. It is preferred to use an alkali to neutralize the bit of acid that transfers to the ball upon impact with the treated court surface. This may be accomplished using a vapor phase such as ammonia or perhaps a hydrazine. Alternatively a solution may be used, but would get the ball wet with an alcohol or water, and may require additional time and heat for drying.

The invention may be carried out using technology similar to carbonless carbon paper image transfer. Carbonless carbon papers are of two different types, micro-encapsulated and multi-coated.

Micro-encapsulation is a process in which tiny particles or droplets are surrounded by a coating to give small capsules with many useful properties. In its simplest form, a microcapsule is a small sphere with a uniform wall around it. The material inside the microcapsule is referred to as the core, internal phase, or fill, whereas the wall is sometimes called a shell, coating, or membrane. Most microcapsules have diameters between a few micrometers and a few millimeters.

In carbonless carbon paper, the transfer system uses an encapsulated dye solution and an acidic medium on a single paper. The pressure of a marking breaks the shell of the microencapsulation, which allows the dye solution to contact the acids and thus to change color. Acidic clays and/or (usually) phenolic resins cause the change of pH and the change of color. This type of carbonless carbon paper is subject to smearing or marking during machine processing or handling.

A second type of carbonless paper uses two different coatings, one on the back side of the top paper and one on the front side of the bottom paper so that a mark is made only when the two papers are in pressured contact with one another. The microencapsulated dye is usually placed on the second paper, and the acidic clay/resin formulation is placed on the first paper. Both the dye and the acidic systems are usually applied to the paper from aqueous suspensions.

In both of these carbonless carbon paper systems, the dye is predissolved in a solvent (usually a hydrocarbon oil) and it is microencapsulated within a shell of gelatin or other polymer. Crystal Violet Lactone (CVL) is the most common leuco dye, and it gives a bluish-purplish color in its transition from neutral to acidic form.

The present invention can use leuco dye encapsulated within a shell that is strong enough to survive foot traffic on a tennis court. In this instance, the dye and an acidic medium are combined within the coating.

A preferred embodiment uses the dye within and on the fibers of the tennis ball and it uses a coating on the tennis court that is of acidic or alkaline pH. A number of dyes and coatings have been found effective in this combination as discussed in the Examples below. Preferred dyes show a color distinction against green, blue and white coatings that are conventionally used on hard athletic surfaces; these preferred dyes are yellow, orange, red and black colors, and intensity of color is also preferred.

In alternative embodiments, the present invention may be used in any setting where an impact point need be determined for a movable object, such as a ball, especially when some type of boundary line is involved. This may include, but would not be limited to baseball, basketball, football, soccer and the like.

DETAILED DESCRIPTION OF THE PREFERRED EMBODIMENTS

Figure 1:
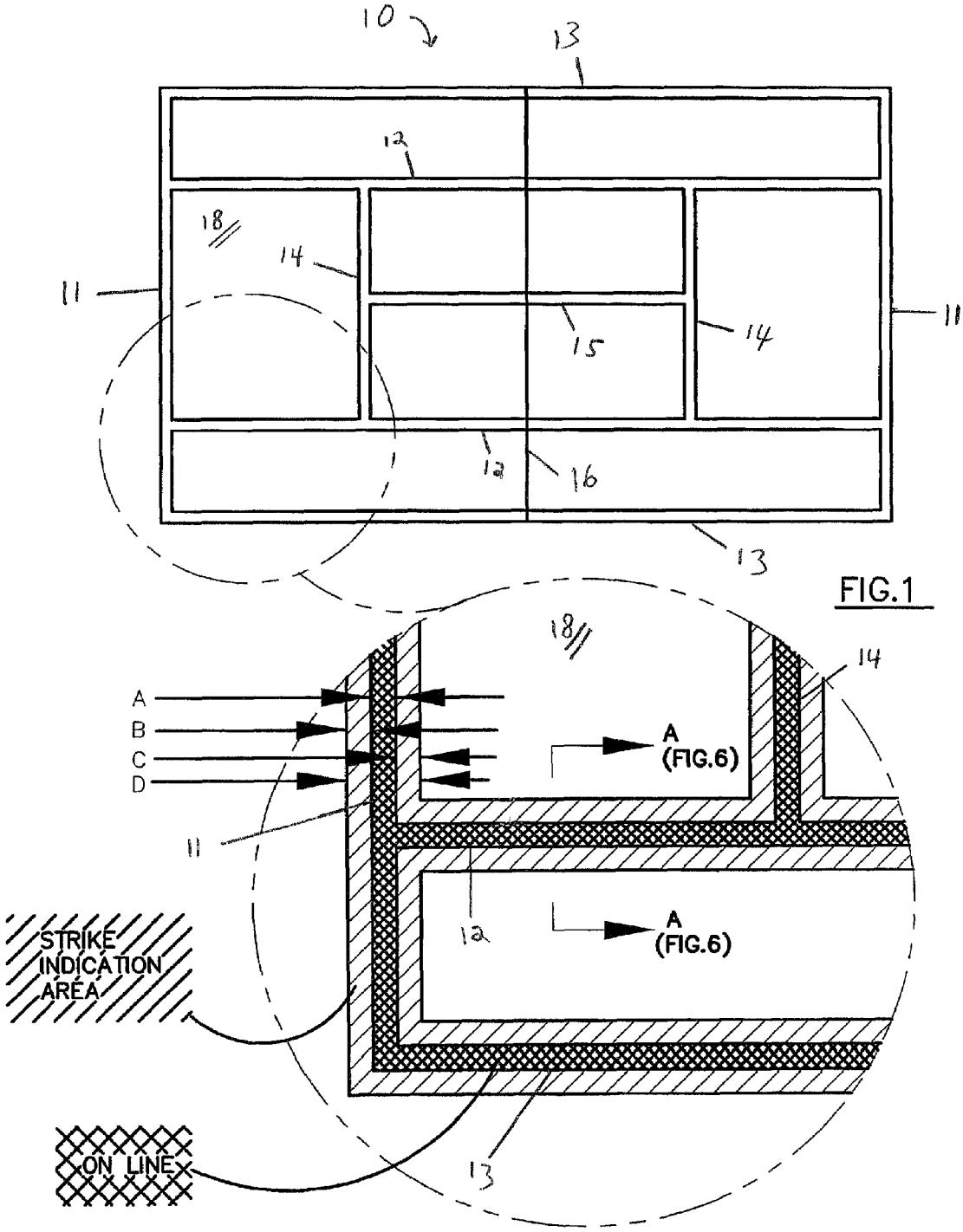
FIG. 1 is a diagram of a standard tennis court with a circular section enlarged and shown in detail.

A standard tennis court 10 has playing surface 18 that is bordered by base lines 11 on two of the four sides. Base lines 11 intersect at right angles with each of singles side lines 12 and doubles side lines 13. Service lines 14 are between lines 12 and are connected by center service line 15 that is a perpendicular bisector of each of lines 14 and extends under net 16 between each of service lines 14.

Each of lines 11, 12, 13, 14, and 15 are boundary lines and are similarly treated. In one preferred embodiment, the court is treated as follows:

To the outside of Baselines 11, apply the receiving composition approximately 6 inches outward from the line (see FIG. 1 enlargement, region B), baseline 11 is 4 inches wide (see FIG. 1 enlargement, region A), receiving composition is applied over baselines 11; and inside baseline 11, apply the receiving composition approximately 4 inches inward (see FIG. 1 enlargement, region C). FIG. 1 is not drawn to scale. The above measurements describing application of the receiving composition are given by way of example. Additionally, the application of the receiving composition may be to any desired distance in relation to the boundary lines.

Next to service lines 14, apply the receiving composition approximately 6 inches outward from the line (i.e. from the service line 14 in the direction of base line 11), service lines 14 are 2 inches wide, receiving composition is applied over service lines 14; and inside service lines 14, receiving composition is applied approximately 4 inches inward.

Next to Center Service line 15—apply the receiving composition on either side of the center line 15 approximately 4 inches and over center line 15 which is typically 2 inches wide.

Singles side lines 12 and Doubles side lines 13 are each treated identically. Apply the receiving composition approximately 6 inches outward from the lines 12 and 13, lines 12 and 13 are 2 inches wide, receiving composition is applied over lines 12 and 13; and inside lines 12 and 13, receiving composition is applied approximately 4 inches inward.

The ball compression itself would be approximately 2 inches when striking the court and therefore the distances given for application of the receiving composition is contemplated as being acceptable to many tennis officials.

These distances were contemplated based on the range of measurement currently utilized by the Cyclops® system. Currently, the Cyclops® system measures 45 cm outside the line service line and 10 cm inside the service line.

As seen in the expansion of FIG. 1, base line 11 has a width A. The invention encompasses treating the surface of court 10 with a receiving composition. Each of lines 11, 12, 13, 14, and 15 are similarly treated (although only one such expansion is shown in the Figures). A Receiving composition 24 is applied a distance B outside said base line 11, over said line 11, and a distant C inside boundary line 11. The total treated distance of A plus B plus C is distance D, which includes the width of the line 11 and the aforementioned applications of B and C.

A conventional tennis ball 30 comprises visible seems and fibers. Ball 30 is treated with striking composition 20. Felt ball fibers 25 have fiber dye 26 disposed thereon and further have dye on nodes 27 where fibers 25 typically intersect. Ball 30 may have any part thereof containing striking composition 20. Preferably, a majority of the ball is coated with composition 20.

When ball 30 treated with striking composition contacts a surface treated with a receiving composition, a chemical reaction occurs due to the interaction of the chemical components in each of striking composition and receiving composition, creating a colored impression on the tennis court. FIGS. 2-5 demonstrate various impressions left when the present invention is used.

Figure 2:
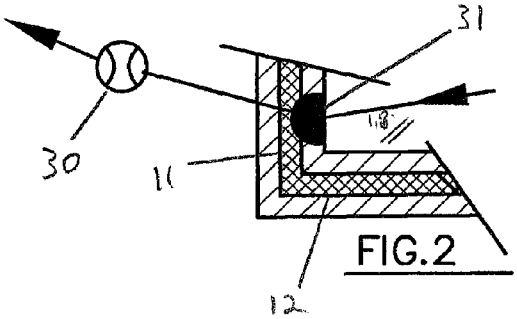
FIG. 2 is an imprint made by a tennis ball, the imprint is left on a portion of the boundary line and on the area inside of the boundary line, where the ball landed "in bounds."

As depicted in FIG. 2, impression 31 indicates the spot where ball 30 has contacted surface 18 that has been treated according to the present invention. FIG. 2 depicts an impression 31 indicating ball 30 landed on the inside of the boundary line contacting both line 11 and surface 18 creating impression 31.

Figure 3:
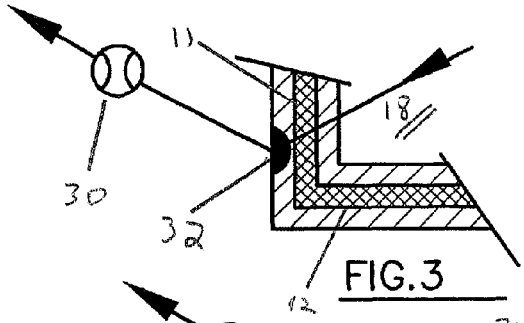
FIG. 3 is an imprint made by a tennis ball, the imprint is left on the outside of the boundary line, where the ball landed "out of bounds."

FIG. 3 depicts impression 32 whereby ball 30 contacted surface 18 outside end line 11.

Figure 4:
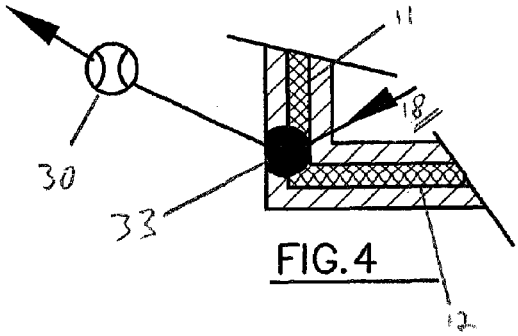
FIG. 4 is an imprint made by a tennis ball, the imprint is left on the boundary line and on the area outside the boundary line and is considered "in bounds."

FIG. 4 depicts impression 33 indicating ball 30 contacted end line 11 on end line 11 and impression 33 extended to the outer part portion of end line 11.

Figure 5:
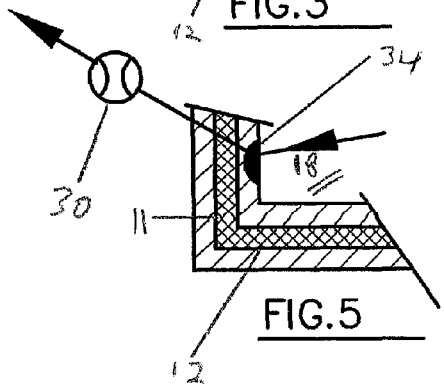
FIG. 5 is an imprint made by a tennis ball, the imprint is left within boundary line, and is considered "in bounds."

FIG. 5 depicts impression 34 of ball 30 indicating ball 30 landed within the boundary of end line 11.

Court surface 18 is typically painted with conventional tennis court paint and coatings as are commonly used and known in the art.

Figure 6:
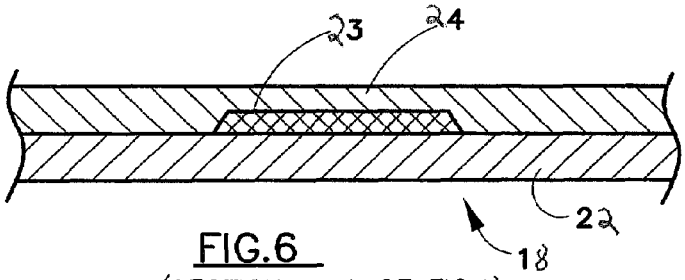
FIG. 6 is a cross-section view of the surface of a hard tennis court taken along line A-A of FIG. 1.
Figure 7:
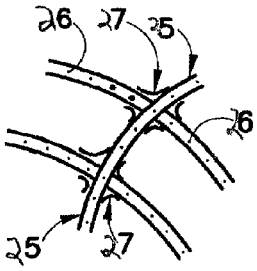
FIG. 7 shows a detail of the felt of a tennis ball.
Figure 8:
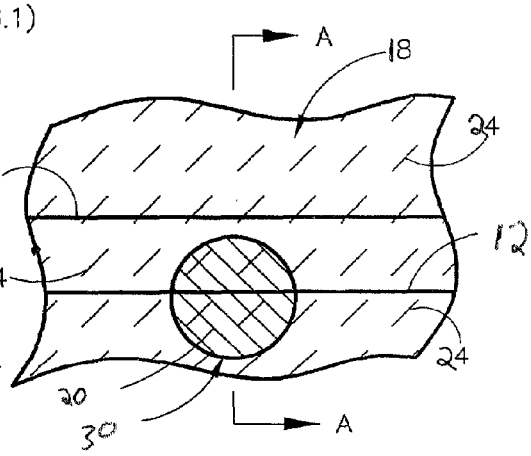
FIG. 8 is similar to FIGS. 2, 3, 4, and 5 showing an alternative view of a boundary line with a ball marking represented by the shaded portion of the drawing, contrasting with both the white line and the background color of the court.

Tennis courts are typically marked with boundary lines 23 standard to the game of tennis. Receiving composition 24 is subsequently disposed on and next to each of lines 11, 12, 13, 14, and 15 on surface 18. Referring to FIG. 6, surface 18 has been prepared with court paint 22, line 23, and receiving composition 24.

EXAMPLES

Examples are given as demonstrative and are not intended to be limiting the scope of the invention.

Most of the examples used a combination of court coating and ball treatment. Objectives were to obtain clear, colorless, non-glossy coatings over conventional tennis court surfaces, distinctive color changes upon impact from tennis balls on the special coating, fast removal of markings on the special coating, and no color change on the tennis balls (or easily reversible color changes).

Example 1

Schenectady® resin HRJ 40234 (SI Group, Schenectady, N.Y.) 8 ml was combined with Schenectady® 14894 microcapsules 32 ml, and a commercial acrylic latex, Minwax® 1265K 16 ml (approximately 30% solids by weight). This material was brushed onto a dark green tennis court coating, World Class Athletics® #TCP065 (World Class Athletic Surfaces, Leland, Miss.) on a hardboard, target Tennis balls were hit to impact the target and markings were inspected and photographed. Bluish-purplish marks were evident, with oval shapes, indicating that the single-paper system of carbonless carbon paper could provide a marking. However scuffs from tennis shoes also marked the coating the same color, indicating that these commercial materials would not be satisfactory for use as a ball impact marking system. We perceive that a stronger shell might be able to respond differently to ball impacts and shoe impacts and may be workable in a single coating system.

Example 2

An alkaline latex court coating was made with cornstarch, 5 gm stirred into water, 20 ml. This was added to sodium hydroxide, 2 gm, dissolved in water, 20 ml. The resultant mixture was added to MinWax clear acrylic latex, 15 ml giving a smooth white mixture, easy to brush, but difficult to spray.

Tennis balls were treated with alum mordant and then were contacted with a solution of phenol red dye, 0.5 gm dissolved in denatured alcohol, 10 ml, plus ethoxyethane, 10 ml. The balls turned an orange color, and they were rinsed five times with denatured alcohol to remove superficial dye.

Tennis ball impacts of these balls on a target with the C-2 coating gave discernible, but not distinct marks.

Example 3

A court coating was made 0.5 grams of Crystal Violet Lactone dye dispersed in Kwal® (Kwal Paint, Denver, Colo.) brand of satin acrylic latex, 15 ml. A tennis ball was treated with a solution of salicylic acid, 32 grams in denatured alcohol, 400 ml (overnight contact, water rinse, dried). The ball was pressed onto the CCP-6 coating and rotated a quarter turn. It made no mark on the coating. A drop of this salicylic acid solution on the coating caused color change to blue, but it was difficult to discern the color difference between the blue and the green background.

Example 4

A court coating was made with Schenectady 14508 developer, 996 ml, Exsilon® 9 acidic clay pigment (Engelhard Corporation, Iselin, N.J.) 80 gm, dispersed in 25 ml of water, mixed with MinWax® acrylic latex (Minwax Company, Upper Saddle River, N.J.) 12 ml. This off-white coating was applied over TCP065 dark green.

Tennis balls were treated with alum mordant (15 grams/gallon of water, heat at 150° F. for 1 hour, cool, rinse with water, dry) and they were then dyed with a solution of Crystal Violet Lactone (CVL), 5 grams in toluene, 100 ml and ethylene glycol methyl ether, 10 ml. Solution contact was about 15 seconds, followed by baking at 150° F. The tennis balls had very little color change. Where contacted with a drop of salicylic acid solution, the color changed to blue, and microscopic examination showed that the dye was absorbed by the wool fibers of the tennis ball.

The tennis balls with the crystal violet dye were hit at the target with the coating of Example 4, and showed readily discernible marks on the coating (good) and on the tennis balls (undesired, but reversible by exposure to vapors of ammonium hydroxide).

Example 5

A tan coating was prepared for better discrimination of color change using Schenectady microcapsule dispersion #18894, 64 ml, added to Kwal® brand of satin latex, color #8264D, 12 ml. Tennis balls were prepared using 32 grams of salicylic acid dissolved in 400 ml of denatured alcohol (overnight contact, water rinse, dried).

Ball impacts on this coating gave chalky markings on the target with little color change from the dye.

Example 6

Schenectady® 4508 developer, 96 ml, was added to MinWax clear acrylic latex, 12 ml, and was applied as a relatively clear, colorless coating over dark green World Class Athletics TCP065 on a panel. Ball treatment was with CVL dye as noted above.

Ball impacts gave dark bluish coloration on both the coating and on the balls. Ball drops from 6-foot height did not give a mark. Dark marks on the ball could be removed by exposure to vapors of ammonium hydroxide.

Example 7

Schenectady® 4508 developer, 96 ml, was added to MinWax® clear acrylic latex, 12 ml and was applied over dark green TCP065 panel. B-14 ball treatment was made with 5 grams of Malachite Green Lactone dye dissolved in 100 ml of toluene. This solution was sprayed onto a rotating ball held with spiders on a slowly rotating lathe. Spraying was accomplished with an airbrush about 4 inches away from the ball and air pressure about 35 psi. The ball was dried at room temperature and then baked 1 hour at 150° F. A drop of salicylic acid on the ball gave indication of good dye absorption into the felt fibers.

Ball hits on white striping paint were distinct, those on the dark green court were not distinct, and there was little impact marking on the balls. Balls with B-2 treatment were very distinct on white striping paint and fairly distinct on the dark green.

Example 8

Schenectady® dry resin #HRJ2053, 20 grams, was added to Gemini 160 sanding sealer (a nitrocellulose-based lacquer), 50 ml, diluted with methyl ethyl ketone, 10 ml and diethylhexylphthalate plasticizer 1 ml. This coating had little color or cloudiness and less gloss than CCP-7.

Impact of balls with B-2 treatment gave good color change on this coating.

Example 9

Salicylic acid, 10 grams, diethylhexylphthalate plasticizer, 1 ml, and Schenectady® solid phenolic resin #2053, 1 gm, were added to 50 ml of denatured alcohol. This gave a hard, non-glossy coating with slightly milky appearance and sparkles from crystals on the surface.

Example 10

Balls B-2T were made by pre-dyeing tennis ball felt with a solution of Crystal Violet Lactone (CVL), 2 grams, in toluene, 100 ml. The felt had been pre-treated with an alum mordant solution, 15 grams in 1 gallon of water, 1 hour at 150° F., rinsed with water and dried. Tennis balls were then made from this felt by Wilson Sporting Goods, Inc. following their normal fabrication process.

Example 11

Balls B-18 were made with a spray of dye solution made from Noveon Specialty Yellow #37 (Noveon Inc., Cleveland, Ohio), 2 grams, toluene, 100 ml and propylene carbonate, 2 ml. After spraying, the balls were placed in a ball tube for 1 hour, then they were washed with water to remove the propylene carbonate and they were dried.

Impacts with both ball treatments gave distinctive markings on white striping, and the yellow markings were better on green than the blue markings. The B-18 balls did not have any color change from impact with the CCP-54 coating.

Example 12

Oxalic acid, 10 gm, Mantrose-Haeuser refined, decolorized shellac #R-49 (Mantrose-Haeuser Company, Westport, Conn.), 1 gm, denatured alcohol, 50 ml. This coating had no gloss, no color, and better initial appearance than above examples. Sprayed onto panel for testing using airbrush.

Example 13

Treatment on ball was Noveon Specialty Orange #14, 2 grams, xylene, 98 ml, propylene carbonate, sprayed, placed in ball can for 1 hour, washed with water, dried.

Fair color distinction with impact of balls with the B-24 orange and the B-2 blue dyes. Colors faded significantly over 24-hour period.

Example 14

Oxalic acid, 10 gm, polyvinylpyrollidone K-30, 1 gm, water, 50 ml gave non-glossy, colorless coating, slow dry. B-28 ball treatment used Noveon Magenta #16 dye, 2 gm, xylene, 100 ml, propylene carbonate 2 ml, sprayed onto tennis ball, held in ball can 1 hour, then washed with water and dried.

System gave good color distinction when swatch of B-28 magenta was pressed and turned against the coating, fair color with B-18 yellow and B-24 orange dye treatments.

The above examples all used solvent dyes. Because wool fibers are proteinaceous, they are often dyed commercially with acidic dyes. The following examples use acidified solvents that dye the felt of a tennis ball with the converted color. This provides a means of quickly confirming that a good dye penetration has been accomplished. The dyed felts are then converted back to their intended color by using ammonia vapor or other neutralizing chemicals.

Example 15

Alkaline chemical added to acrylic court coating, e.g. sodium silicate, sodium tetraborate, either while wet or impregnated after dry, with a phenolphthalein-type color change going from neutral to alkaline.

Because ball marks needed to be removed frequently and quickly (about 90 seconds are available during court direction changes after sets 1, 3, 5 . . .) examples of color removal systems are shown. Treatment with alkali is one means of converting the dye back to its original colorless chemistry, but residual, nonvolatile alkali neutralizes the acidity of the CCP coating and makes it inactive in the case of a second hit by the ball in the area that has been treated. Most of the leuco dyes are soluble in aromatic solvents and other solvents having a relatively low Hildebrand solubility parameter. Dissolution of the dye and wiping to remove it is a means of decolorizing the ball mark, if the solvent does not also dissolve and remove the acid in the special coating.

Example 16

Ammonium bicarbonate, 10 grams dissolved in 50 ml water+50 ml methanol was sprayed onto ball impact marks and was dried with a heat gun without wiping. Yellow and orange marks disappeared quickly, but blue and magenta colors did not go colorless.

Example 17

Salicylic acid 10 grams dissolved in denatured alcohol, 50 ml with Schenectady® phenolic resin 2053 1 gm and diethylhexyl phthalate 1 ml was sprayed onto ball impact marks. The marks immediately became more intense by virtue of the additional acidity and dissolution of the dye. The marks were blotted with a soft cloth or paper towel to remove the dissolved dye. The residual coating remained active for marking subsequent ball hits.

Example 18

A commercial solution of xylene, methanol, acetone and heptane was sprayed onto ball impact marks and it was promptly blotted with a paper towel, removing the marks, but leaving the surface de-activated for subsequent ball hits.

Example 19

Glacial acetic acid was sprayed onto a ball mark and was blotted dry. Within 20 seconds, the color of the mark disappeared.

The preferred remover/activator is formula R-19, a solution of salicylic acid, 10 grams and PVP K-30 1 gram, in methanol 30 ml and toluene 30 ml with 1 ml of lactic acid.

These test were repeated to confirm surface activity after the removing steps.

While the invention has been described in its preferred form or embodiment with some degree of particularity, it is understood that this description has been given only by way of example and that numerous changes in the details of construction, fabrication, and use, including the combination and arrangement of parts, may be made without departing from the spirit and scope of the invention.

We claim:

1. A process for determining point of contact of a movable object on a surface comprising:

(a) disposing a striking composition having a leuco dye to a movable object;

(b) disposing a receiving composition to a surface, wherein said receiving composition reversibly changes from colorless to colored at a pH between 3-11;

(c) observing a colorimetric indicia of contact at the point of impact on said surface portion where said movable object contacts said surface treated with said receiving composition; and (d) removing from view said colorimetric indicia from said surface in less than 90 seconds.

2. The process of claim 1 wherein said surface is a tennis court.

3. The process of claim 1 wherein said movable object is a tennis ball.

4. The process of claim 1 wherein said striking composition is disposed on a tennis ball.

5. The process of claim 1 wherein said striking composition is applied using an organic solvent.

6. The process of claim 1 wherein said striking composition is applied using an aqueous solvent.

7. The process of claim 1 wherein said striking composition is applied using an aqueous-organic cosolvent.

8. The process of claim 1 wherein said striking composition is applied to at least 5 percent of said movable object.

9. The process of claim 1 wherein said striking composition applied to said movable object is on individual fibers of tennis ball felt.

10. The process of claim 1 wherein said receiving composition is applied to the inner and outer regions adjacent to boundary lines of a tennis court.

11. The process of claim 1 wherein said receiving composition is acidic and said striking composition is basic.

12. The process of claim 1 wherein said receiving composition is basic and said striking composition is acidic.

13. The process of claim 1 wherein said removal substantially eliminates said colorimetric indicia.

14. The process of claim 1 wherein said observing of colorimetric indicia is observed only on said tennis court surface.

15. The process of claim 1 wherein said receiving composition is applied to boundary lines.

16. A method for determining the point of impact of a tennis ball comprising:

(a) treating a tennis court surface with a receiving composition;

(b) treating a tennis ball with a striking composition;

(c) contacting treated tennis balls on said treated court;

(d) said contact creating on impact a colorimetric impression of said treated tennis ball on said tennis surface court treated with said receiving composition;

(e) observing the colorimetric change at the point the tennis ball, with a striking composition, contacts the tennis court with a receiving composition; and (f) removing said calorimetric change from view on said tennis court with a removing composition in less than 90 seconds.

17. The method of claim 16 wherein said hard court is treated with said receiving composition in the area immediately outside tennis court side lines and end lines.

18. The method of claim 16 wherein said removing composition is an organic solvent, inorganic solvent, or combinations thereof.

19. The method of claim 16 wherein said receiving composition is applied to boundary lines.

20. An article for determining the area of impact on a treated surface wherein said article comprises a striking composition disposed on its surface, wherein said striking composition exhibits a colorimetric change on said treated surface that is removable with a removing composition in less than 90 seconds.

21. The article of claim 20 wherein said striking composition comprises a dye.

22. The article of claim 21 wherein said dye is applied using an organic solvent.

23. The article of claim 21 wherein said dye is applied using an aqueous solvent.

24. The article of claim 21 wherein said dye is applied using an aqueous-organic cosolvent.

25. The article of claim 24 wherein said article is a ball.

26. The article of claim 21 wherein said dye is applied to at least 5 percent of said movable object.

* * * * *